US005273557A

United States Patent [19]

Cerutti et al.

[11] Patent Number: 5,273,557

[45] Date of Patent: Dec. 28, 1993

[54] TWIST DRILLS HAVING THERMALLY STABLE DIAMOND OR CBN COMPACTS TIPS

[75] Inventors: David B. Cerutti; David E. Slutz, both of Worthington, Ohio; Thomas J. Broskea, Plymouth Crossing, Mich.

[73] Assignee: General Electric Company, Worthington, Ohio

[21] Appl. No.: 577,379

[22] Filed: Sep. 4, 1990

[51] Int. Cl.[5] ..... B24D 3/00

[52] U.S. Cl. ..... 51/293; 51/295; 51/309

[58] Field of Search ..... 51/293, 295, 309

[56] References Cited

U.S. PATENT DOCUMENTS

| | | | |
|---|---|---|---|
| 4,534,773 | 8/1985 | Phaal et al. | 51/293 |
| 4,682,987 | 7/1987 | Brady et al. | 51/293 |
| 4,694,918 | 9/1987 | Hall | 51/293 |
| 4,770,673 | 9/1988 | Ketcham et al. | 51/309 |
| 4,793,828 | 12/1988 | Burnand | 51/293 |
| 4,899,922 | 2/1990 | Slutz et al. | 51/293 |
| 4,941,891 | 7/1990 | Tank et al. | 51/293 |
| 4,956,238 | 9/1990 | Griffin | 51/293 |
| 4,987,800 | 1/1991 | Gasan et al. | 51/293 |
| 4,995,887 | 2/1991 | Barr et al. | 51/295 |
| 5,045,092 | 9/1991 | Keshavan | 51/293 |
| 5,061,293 | 10/1991 | Barr et al. | 51/293 |

*Primary Examiner*—Mark L. Bell
*Assistant Examiner*—Willie J. Thompson

[57] ABSTRACT

The present invention is directed to rotary drill bits and blanks which retain polycrystalline diamond or CBN compacts, but which do not suffer from disadvantages attendant by prior drill designs. The inventive rotary drill bit has a slot within the head thereof which slot has brazed therein with a brazing alloy preferably having a liquidus greater than 700° C. an unsupported thermally-stable polycrystalline diamond or CBN compact. The drill bit is made in another aspect of the invention by forming a slot in the head of the rotary drill and then brazing an unsupported thermally-stable polycrystalline diamond or CBN compact therein with a brazing alloy preferably having a liquidus greater than 7000° C. For present purposes, polycrystalline diamond and CBN compacts are termed "thermally stable" by being able to withstand a temperature of 1200° C. in a vacuum without any significant structural degradation of the compact occurring.

22 Claims, No Drawings

TWIST DRILLS HAVING THERMALLY STABLE DIAMOND OR CBN COMPACTS TIPS

BACKGROUND OF THE INVENTION

The present invention relates to rotary drill bits (e.g. twist, spade, etc.) and more particularly to the use of thermally-stable compacts therewith to enable high speed boring of materials.

Heretofore, rotary drills commonly were fabricated from hardened steel. Occasionally, such drills were tipped with tungsten carbide which is a harder material. Later, drill bits fashioned out of tungsten carbide were developed for special applications.

Recently, drill bits have been tipped with superabrasive materials including diamond and cubic boron nitride (CBN). Several methods for tipping drills with superabrasives have been proposed in the art. One proposal is to coat a tungsten carbide drill with a diamond or CBN coating. The usefulness of such coatings has been determined to be dependent at least in part on the thickness of the coating. Fairly thin coatings result in minimal drilling improvement. In the case of ferrous drilling applications, particularly at very high speeds, the reaction of diamond with the ferrous workpiece is a problem. A CBN coating would solve this problem, but no commercial CBN coatings have been available to date.

Another proposal for tipping drills with superabrasives is to add an insert made of the superabrasive to the tip of the drill. One of the major problems in this approach is the attachment of the superabrasive to the slotted tip since CBN and diamond cannot be easily wetted and brazed. This problem, however, typically is solved by making a sandwich of tungsten carbide surmounting the inner core of diamond or CBN. Unfortunately, sandwich compacts necessarily demand larger slots if the same thickness of diamond or CBN layer is to be retained. Larger slots, however, can lead to weakness of the drill tip retaining the sandwich compacts and cannot practically be accommodated by small diameter drill bits.

BROAD STATEMENT OF THE INVENTION

Broadly, the present invention is directed to rotary drill bits as blanks which retain polycrystalline diamond or CBN compacts, but which do not suffer from disadvantages attendant by prior drill designs. The inventive rotary drill bit has a slot within the bead thereof which slot has brazed therein with a brazing alloy including those having a liquidus greater than 700° C., an unsupported thermally-stable polycrystalline diamond or CBN compact. The drill bit is made in another aspect of the invention by forming a slot in the head of the rotary drill and then brazing an unsupported thermally-stable polycrystalline diamond or CBN compact therein with a brazing alloy. For present purposes, polycrystalline diamond and CBN compacts are termed "thermally stable" by being able to withstand a temperature of 1200° C. in a vacuum without any significant structural degradation of the compact occurring.

Advantages of the present invention include the ability to fabricate rotary drill bits with superabrasive compacts in a configuration that maximizes the thickness of the compact at minimum slot thicknesses within the rotary drill bit head. Another advantage is the ability of the rotary drill bits to function effectively at very high speeds and penetration rates. These and other advantages will be readily apparent to those skilled in the art based upon the disclosure contained herein.

DETAILED DESCRIPTION TO THE INVENTION

Referring initially to thermally-stable polycrystalline diamond compacts, reference is made to U.S. Pats. Nos. 4,214,380 and 4,288,248 which provide a full disclosure thereof. Briefly, these thermally-stable polycrystalline compacts comprise diamond particles which comprise between about 70% and 95% by volume of the compact. A metallic phase of sintering aid material is present substantially uniformly throughout the compact and is in a minor amount, typically ranging from about 0.05 to about 3% by volume of the compact. A network of interconnected empty pores are dispersed through the compact and are defined by the diamond particles and the metallic phase. Such pores generally comprise between about 5% and 30% by volume of the compact. Thus, these compacts often are termed "porous compacts".

European Patent publication No. 116,403 describes a thermally-stable diamond compact comprising a mass of diamond particles present in an amount of 80% to 90% by volume of the body and a second phase present in an amount of 10% to 20% by volume of the body, the mass of diamond particles containing substantially diamond-to-diamond bonding to form an adherent skeletal mass and the second phase containing nickel and silicon, the nickel being in the form of nickel and/or nickel silicide and the silicon being in the form of silicon, silicon carbide, and/or nickel silicide. British patent application No. 8508295 describes a thermally stable diamond compact comprising a mass of diamond particles present in an amount of 80% to 90% by volume of the compact and a second phase present in an amount of 10% to 20% by volume of the mass, the mass of diamond particles containing substantially diamond-to-diamond bonding to form an adherent skeletal mass and a second phase consisting essentially of silicon, the silicon being in the form of silicon and/or silicon carbide.

With respect to thermally-stable polycrystalline CBN compacts, a preferred direct conversion process as disclosed in U.S. Pat. No. 4,188,194 involves placing preferentially oriented pyrolytic hexagonal boron nitride (PBN) in a reaction cell wherein the boron nitride is substantially free of catalytically active materials. The cell and the contents then are compressed at a pressure of between about 50 Kbars and 100 Kbars while being heated to a temperature of at least about 1800° C. within the CBN stable region of the BN phase diagram. The HP/HT conditions then are maintained for a period of time sufficient for the pyrolytic boron nitride to transform into a sintered polycrystalline cubic boron nitride compact. When hexagonal boron nitride (HBN) is milled to a small particle size (large surface area), an improvement in such process is disclosed in U.S. Pat. No. 4,289,503, wherein boric oxide is removed from the surface of the HBN at or before the conversion process. Such pretreatment is carried out at a temperature in the hexagonal boron nitride decomposition range and is accomplished by vacuum firing and heating under vacuum or inert atmosphere.

Improved sintered boron-rich polycrystalline CBN compacts are disclosed in U.S. Pat. No. 4,673,414. Such proposal for making sintered polycrystalline CBN compacts comprises placing sintered boron-rich polycrystalline CBN particles in a high temperature/high pressure apparatus and subjecting said boron-rich CBN particles to a pressure and temperature adequate to re-sinter the CBN particles, the temperature being below the reconversion temperature of CBN to HBN, for a time sufficient to re-sinter the polycrystalline CBN particles therein, the combination of pressure and temperatures in the CBN stable region of the phase diagram for boron nitride. The temperature then is reduced sufficiently to inhibit reconversion of CBN to HBN (typically 1,000° or less) followed by reduction of the pressure and recovery of the re-sintered polycrystalline CBN compact. This process also is conducted in the absence of catalytic material or catalyst. Other material (sintering inhibiting impurities) which might interfere with or inhibit the sintering of boron-rich polycrystalline CBN particles also are taught to be avoided.

Regardless of the precise form of polycrystalline diamond or CBN compact chosen, each is typified by being "thermally-stable" as defined above. By being thermally-stable compacts, the compacts can be subjected to substantially higher brazing conditions which enables sufficient wetting of the diamond and CBN particles for their attachment into slots provided in the drill heads. It will be appreciated that diamond is the most difficult of materials to wet and CBN is only slightly easier to wet than is diamond. Since catalytic metal is substantially absent from thermally-stable compacts, the compacts can be subjected to higher brazing temperatures without fear of degradation of the compacts due to the difference in thermal expansion between metal catalyst and the diamond or CBN material itself. Since the thermally-stable compacts are not supported, i.e. with tungsten carbide or the like, adequate wetting of the particles by the brazing alloy is required. In this regard, it will be appreciated that the thermally-stable compacts can be coated with a metal to enhance their oxidation resistance during the brazing operation and/or to Unprove the bonding of the compacts to the drill head, such as disclosed, for example, in U.S. Pat. No. 4,738,689. Suitable coatings include, for example, nickel, copper, titanium, tungsten, niobium, zirconium, vanadium, molybdenum, and alloys, compounds, and mixtures thereof. Coating thicknesses advantageously can be at least about 8 microns and can range on up to 150 microns or more.

The compacts brazed in the drill head slot appear to be effectively supported so that the brazing alloy composition becomes more tolerant with respect to choice. A wide variety of brazing alloys should function efficaciously, though high liquidus brazing alloys are preferred by the art.

Referring to the brazing alloys having a liquidus greater than 700° C. and which are useful in accordance with the precepts of the present invention, a wide variety of such braze alloys are known in the art. For example, Anaconda 773 filler metal (copper 50%, zinc 40%, nickel 10%, melting point range 950°-960° C.) can be used, though it has been reported to undesirably react with carbide pieces being joined, so that its use with carbide drills may not be recommended. Another brazing filler metal which has been proposed is TiCuSil (Ti-4.5%, Cu-26.7%, Ag-balance, melting point range 840°-850° C.). However, TiCuSil does not braze well unless brazing is conducted under vacuum or inert atmosphere, but is the presently-preferred brazing alloy tested to date. Other alloys include a palladium (28-32%), chromium (6%-13%), boron (1%-3.5%, and nickel (balance) brazing alloy described and claimed in U.S. Pat. No. 4,414,178. This alloy is described as being capable of brazing in the 982°-1093° C. temperature range. Additionally, U.S. Pat. No. 4,527,998 discloses additional gold-based alloys s follows: gold (18%-39.5%), nickel (3.5%-14.5%), palladium (2.5%-10.5%), manganese (7.5%-9.0%), and copper (balance). Most brazing alloy compositions reported within these ranges have liquidus between 900° and 1,000° C. Finally, U.S. Pat. No. 4,899,922 proposes the use of brazing alloys having a liquidus above 7000° C. and containing an effective amount of chromium for bonding of thermally-stable compacts. Titanium-bearing brazing alloys are preferred for brazing thermally-stable polycrystalline diamond compacts, e.g. EZ Flow 3 (630°-695° C. liquidus) and EZ Flow (605°-640° C. liquidus), following their coating with W and heat treating. For thermally-stable CBN, $T_iC_uSil$ or similar vacuum braze is preferred.

The slots in the head of the drill bits can be formed during the bit formation operation, or they can be cut afterwards utilizing a diamond saw, grinding wheel, laser, or electro discharge machining (EDM) techniques. Regardless of the technique employed to create the slots in the head of the drill bits, the thermally-stable polycrystalline compact, or multiple compacts, are placed in the slot and brazed with a brazing alloy, typically in a furnace held under vacuum or inert gas conditions. The compact thicknesses often will range from about 0.2 mm to 2.0 mm and the slots must be cut only slightly larger to accommodate the compacts and a layer of the brazing alloy.

While conventional drill speeds and penetration rates are quite suitable for the novel rotary drill bits, high drill speeds (10,000 to 100,000 rpm) and penetration rates (50 to 1,000 cm/min) are being proposed in industry, for example in the drilling of engine block components. The inventive rotary drills bearing the brazed unsupported thermally-stable polycrystalline compacts should find success in these applications.

In this application, all percentages and proportions are by weight and all units are in the metric system, unless otherwise expressly indicated. Also, all citations referred to herein are expressly incorporated herein by

IN THE EXAMPLES

Example 1

Straight flute through coolant 0.312 in. diameter drills had a slot cut by electrode discharge machining (EDM) into the drill heads to accept 0.060 in. thick thermally-stable CBN compacts. The compacts were brazed with TiCuSil brazing alloy. Relief angles and point angles were varied as set forth below.

TABLE 1

| Drill No. | Point Angle (deg.) | Relief Angles (deg.) |
|---|---|---|
| 1 | 118 | 10-primary<br>25-secondary |
| 2 | 118 | 10-primary<br>25-secondary |
| 3 | 135 | 10-primary<br>25-secondary |
| 4 | 135 | 7-primary<br>25-secondary |

The results recorded are set forth below.

TABLE 2

| Drill No. | Drill Speed (RPM) | Feed Rate (IPM | Results/Comments |
|---|---|---|---|
| 1 | 20,000 | 120 | 5 holes-OK |
| | 20,000 | 160 | 8th hole-ok |
| | 200 | 200 | Drill broke in 9th hole |
| | | | Complete fracture along point |
| 2 | 25,000 | 150 | 3 holes-OK |
| | 200 | 200 | 65th hole-OK |
| | | | Drill broke at 98th hole |
| | | | H.P. jump at hole 96 |
| 3 | 25,000 | 100 | 3 holes-OK |
| | | 100 | 21 holes-OK |
| | | 100 | 84 holes-OK |
| | | 100 | 462 holes-OK |
| | | | slight wear on front lip-one side other lip-no wear |
| | | 100 | 966 holes-Drill pulled |
| | | | Power jump-drill chipped near center point. |
| 4 | 25,000 | 100 | 5 holes-OK |
| | | 150 | 37th hole-OK |
| | | 200 | 55th hole-Pulled drill |
| | | | H.P. jump-Drill chipped |
| 5 | 25,000 | 100 | Stopped test in 5th hole |
| | | | Continuous power increase. |
| | | | Wear on margins-slight chipping near center of drill. |

Conventional high special steel (HSS) and cemented WC drills typically are rdn at 8–10 in/min penetration rates. Higher penetration rates would result in less than 100 holes drilled per drill. The inventive drill bit operates at high penetration rates and has shown the ability to drill around 1,000 or Example 2

Thermally-stable diamond compacts prepared from 4.5 micron, 9%–10 micron 25 micron, and 35 micron feedstocks were coated with 10–20 micron coatings of W by a low pressure CVD process at 550° C. and then heated to 850° C. to react the W coating with the diamond. Samples of such coated compacts had been tested previously for shear strength and the coating was found to exceed 30 kpsi.

The coated compacts were induction brazed into 8-facet (0.191 in. O.D.) drill bits using EZ-Flow 45 brazing alloy. The drill bits were used to drill graphite composites at 9,000 rpm at 27 in/min. The drills evidenced no appreciable wear after 180 inches of material had been drilled. This performance is more than ten times that of a carbide drill.

We claim:

1. A twist drill having a slot within the head thereof which slot bas brazed therein with a brazing alloy an unsupported thermally-stable polycrystalline diamond or CBN compact.

2. The twist drill of claim 1 wherein said unsupported thermally-stable polycrystalline diamond compact comprises/between about 70% and 95% by volume diamond particles and has a network of interconnected empty pores dispersed throughout the compact.

3. The of claim 1 wherein said unsupported thermally-stable polycrystalline CBN compact is made by the direct conversion of preferentially oriented pyrolytic hexagonal boron nitride substantially free of catalytically active materials.

4. The of claim I wherein said pyrolytic hexagonal boron nitride was subjected to treatment wherein boron oxide was removed from the surface at or before the conversion process.

5. The twist drill of claim 1 wherein said unsupported thermally-stable polycrystalline CBN compact was made by re-sintering boron-rich polycrystalline CBN particles at high temperature/high pressure.

6. The of claim 1 wherein said unsupported thermally-stable polycrystalline compact is coated with a layer of metal before it is brazed, into said slot.

7. The twist drill of claim 6 wherein said metal of said coating is selected from the group consisting of nickel, copper, titanium, tungsten, niobium, zirconium, vaila(-,Iiulil, inolybdenum, and alloys and mixtures thereof.

8. The twist drill of claim 1 wherein said brazing alloy has a liquidus greater than 700° C.

9. The twist drill of claim 8 wherein said brazing alloy is selected from the group consisting of copper-50%, zinc-40%, nickel-10%, melting point range 950°–960°; titanium-4.5%, copper-26.7%, silver-balance, melting point range 840°–850°; gold-18%–39.5%, nickel-3.5%14.5%, palladium-2.5%–10.5%, manganese-7.5%–9%, and copper-balance, having a liquidus between 900° and 1000° C.; and a brazing alloy having a liquidus above 700° and containing an effective amount of chromium for bonding of said thermally-stable compact.

10. The twist drill of claim 1 wherein said unsupported thermally-stable polycrystalline compact has a thickness of between about 0.2 and 2.0 mm.

11. A method for making a twist drill which comprises:

(a) forming a slot in the head of said rotary drill; and (b) brazing an unsupported thermally-stable polycrystalline diamond or CBN compact therein with a brazing alloy.

12. The method of claim 11 wherein said unsupported thermally-stable polycrystalline diamond compact comprises between about 70% and 95% by volume diamond particles and has a network of interconnected empty pores dispersed throughout the compact.

13. The method of claim 11 wherein said unsupported thermally-stable polycrystalline CBN compact is made by the direct conversion of preferentially oriented pyrolytic hexagonal boron nitride substantially free of catalytically active materials.

14. The method of claim 11 wherein said pyrolytic hexagonal boron nitride was subjected to treatment wherein boron oxide was removed from the surface at or before the conversion process.

15. The method of claim 11 wherein said unsupported thermally-stable polycrystalline CBN compact was made by re-sintering boron-rich polycrystalline CBN particles at high temperature/high pressure.

16. The method of claim 11 wherein said unsupported thermally-stable polycrystalline compact is coated with a layer of metal before it is brazed into said slot.

17. The method of claim 16 wherein said metal of said coating is selected from the group consisting of nickel, copper, titanium, tungsten, niobium, zirconium, vanadium, molybdenum, and alloys and mixtures thereof.

18. The method of claim 11 wherein said brazing alloy has a liquidus greater than 700° C.

19. The method of claim 18 wherein said brazing alloy is selected from the group consisting of copper-50%, zinc-40%, nickel-10%, melting point range 950°–960°; titanium-4.5%, copper-26.7%, silver-balance, melting point range 840°–850°; gold-18%–39.5%, nickel-3.5%–14.5%, palladium-2.5%–10.5%, manganese-7.5%–9%, and copper-balance, having a liquidus between 900° and 100° C.; and a brazing alloy having a liquidus above 700° and containing an effective amount of chromium for bonding of said thermally-stable compact.

20. The method of claim 11 wherein said unsupported thermally-stable polycrystalline compact has a thickness of between about 0.2 and 2.0 MM.

21. The method of claim 11 wherein said slot is formed in the head of said twist drill by a saw, using a laser, or by electro-discharge machining techniques.

22. The method of claim 11 wherein said drill stock and compact are fluted.

* * * * *